United States Patent [19]

Greene

[11] 4,223,888

[45] Sep. 23, 1980

[54] GAME FOR SWIMMING POOLS

[76] Inventor: Robin R. Greene, P.O. Box 881, Reseda, Calif. 91335

[21] Appl. No.: 7,646

[22] Filed: Jan. 29, 1979

[51] Int. Cl.[3] ..... A63B 5/02

[52] U.S. Cl. ..... 272/103; 272/1 B; 273/393

[58] Field of Search ..... 272/1 R, 1 B, 26, 102, 272/103, 66, 100, 109, 70.1, 70.2; 273/102 R, 102 A, 102 AP, 102 S, 102.1 R, 102.1 CM, 102.1 E, 102.1 F, 1 M, 1 RS, 1 R, 1.5 A; 248/223.3, 548; 256/47, 48, 50, 54, 56; 254/191

[56] References Cited

U.S. PATENT DOCUMENTS

| | | | |
|---|---|---|---|
| 507,966 | 10/1893 | Bradford | 256/48 |
| 1,808,371 | 6/1931 | Oertel | 272/103 |
| 2,185,055 | 12/1939 | Driscoll | 273/102 AP X |
| 3,497,212 | 2/1970 | Gotcher | 272/103 |
| 3,900,194 | 8/1975 | Ward et al. | 272/1 B |

FOREIGN PATENT DOCUMENTS

| | | | |
|---|---|---|---|
| 254972 | 12/1912 | Fed. Rep. of Germany | 272/102 |

OTHER PUBLICATIONS

Kusan, Inc. Water Sports Catalog, Model 1525 Game Base Set, received at 1977 New York, N.Y. Toy Fair.

*Primary Examiner*—Richard C. Pinkham
*Assistant Examiner*—Arnold W. Kramer
*Attorney, Agent, or Firm*—Gilbert Kivenson

[57] ABSTRACT

A diving game for swimming pools in which an adjustable hurdle carrying removable targets is extended across the width of the pool between two standards having weighted base supports. The hurdle is provided with a spring loaded release means so that it will not drop should it be contacted by a diver's body as he attempts to clear it and remove targets.

4 Claims, 6 Drawing Figures

GAME FOR SWIMMING POOLS

BACKGROUND AND SUMMARY OF THE INVENTION

The present invention relates to a game apparatus for use with swimming pools. It provides a new form of aquatic competition and helps develop diving skills. The game involves a combination of clearing a hurdle and object retrieval which presents new challenges to the diver. In using the present invention the diver must not only master the hurdle but must also orient his body so that he can retrieve as many of the targets in his path as possible. This requires increased coordination and physical skill.

The invention comprises a pair of weighted and adjustable support standards, a horizontally mounted and easily releasable cord hurdle and a series of loosely suspended targets. In one form of the game the diver attempts to capture a maximum number of targets as he passes over the cord. He must have these firmly in his grasp when he surfaces. Targets which are dropped or knocked off at any time during the dive count against the diver. Numbers on the targets collected determine the individual's score for that dive.

Various rules can be set up to determine the length of a game and other conditions of play. When a fairly uniform degree of skill has been achieved by the participants, the difficulty of play can be increased by increasing the hurdle height or distance from the diving board.

One object of the invention is to provide a dual challenge for the diver: the clearing of a hurdle and the rapid seizing of objects loosely mounted on the hurdle.

Another object of the invention is to provide apparatus with which a number of aquatic games can be readily formulated and played.

Another object of the invention is to protect each participant should he or she fail to clear the hurdle.

Another object of the invention is to provide light weight and readily storable equipment which can be easily deployed.

Another object of the invention is to incorporate means to alter the amount of physical dexterity required so that persons of varying diving skills can be accommodated.

Other objects of the invention will become apparent when the following detailed specifications are read along with an examination of the accompanying drawings.

DESCRIPTION OF THE INVENTION

Figure 1:
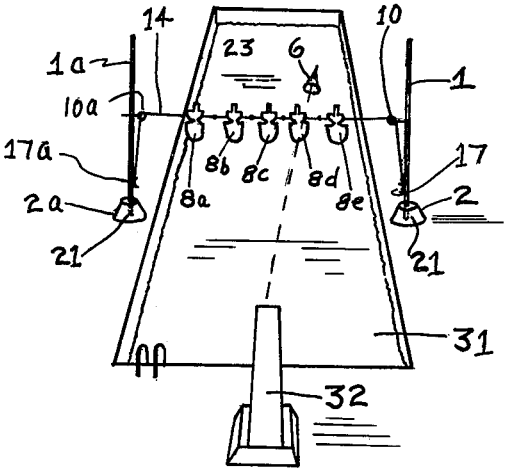
FIG. 1 is an overall view of one embodiment of the invention as it is applied in a swimming pool.
Figure 2:
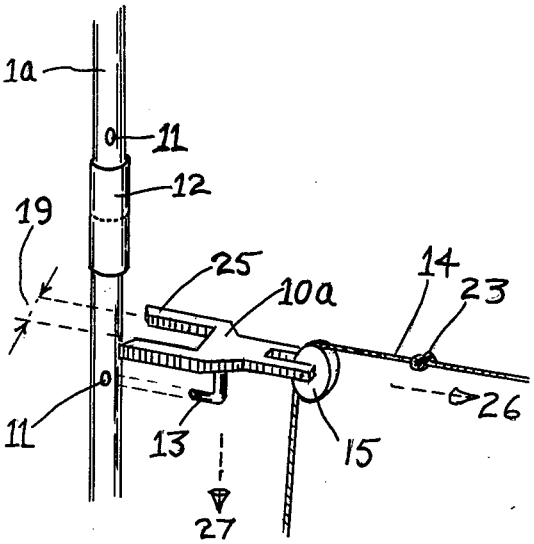
FIG. 2 is a partial view of a vertical standard and a safety release clip.

The game is set up in a swimming pool 31 as is shown in FIG. 1. The base supports 2 and 2*a* are first positioned along the sides of the pool. The vertical standards 1 and 1*a* are then fitted into close fitting holes 21 in the supports. The standards are preferably made up of two or more lengths of tubing held together by the coupling 12 as shown in FIG. 2. Plastic is a preferred material for the base supports and vertical standards to achieve lightness and corrosion resistance.

The clips 10 and 10*a* are then fitted into the standards. The clips incorporate the flexible fingers 25 separated by the spacing 19 which is slightly less than the diameter of the vertical standards. A pin 13 in each clamp is sized to fit loosely into any of the spacing holes 11 in the standards. As a result of this construction the clamps may be attached to the standards at any desired height and will remain in position against a certain amount of dislodging force. The clamp will release when horizontally or downwardly applied forces, as shown by the arrows 26 and 27 respectively in FIG. 2, exceed this amount.

Figure 4:
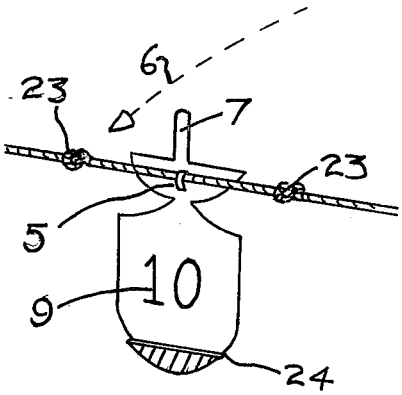
FIG. 4 is a view of one of the targets indicating how it is mounted on the cross cord used as the hurdle.
Figure 5:
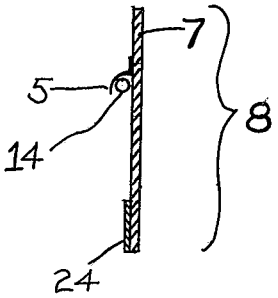
FIG. 5 is a cross section of a target.

Each clamp incorporates a pulley 15 through which the cord 14 is passed. The cord is knotted at regular intervals 23 along its horizontal portion. After the cord is threaded through the pulleys and prior to its being drawn up, the targets 8*a*,8*b*,8*c*,8*d* and 8*e* are hung on it, FIg. 1. The targets are held on the cord by means of the open ended hooks 5 shown in FIGS. 4 and 5. The number of targets, arbitrarily shown as five in FIG. 1 will vary with the width of the pool, the number of participants and the particular game being played.

The cord is then drawn up so that its center portion is approximately horizontal and the excess cord on either end is fastened to the cleats 17 and 17*a*.

Each target incorporates a handle 7 to permit grasping and lifting from the cord. The scoring value of each target is indicated by the numerals 9 printed on one side. This side is placed away from the diver's approach in one version of play. Each target contains the weight 24 to stabilize it against wind.

Figure 3:
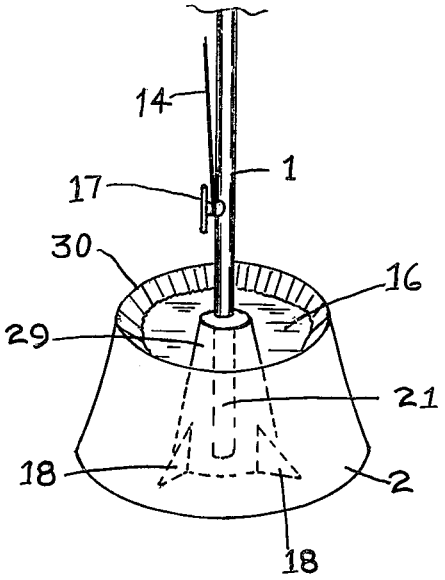
FIG. 3 shows details of a weighted base support for holding the vertical standards.

The base support, shown in FIG. 3, comprises an inner conic section 29 contained in and integrally molded with an outer housing 30. Ribs 18 add rigidity to the structure. The base supports are weighted by adding water to the annular space 16.

One game of the many which are possible starts with the tossing of coins to determine which diver will be first. Each participant dives along a trajectory 6 as shown in FIG. 1 in order to clear the hurdle and to permit him to move his arms. While in the air he seizes as many targets as possible. The numbers on the back of the seized targets determine his score for the dive. A dropped target results in a loss of score equal to its imprinted value. The penalty continues with each dropped target until zero is reached and the diver must start building his score again. Failure to clear the hurdle results in the diver being penalized for all the targets remaining on the cord. When all the targets have been legally removed, a round has been completed. The first player to accumulate 100 points wins the game.

The difficulty of the game may be varied by raising or lowering the height of the hurdle or by changing its distance from the point of diving.

It will be apparent that other games using the basic principle of the invention can be devised and played. The game can, for example, consist of attempting to place the targets on the cord during a dive rather than removing them.

Figure 6:
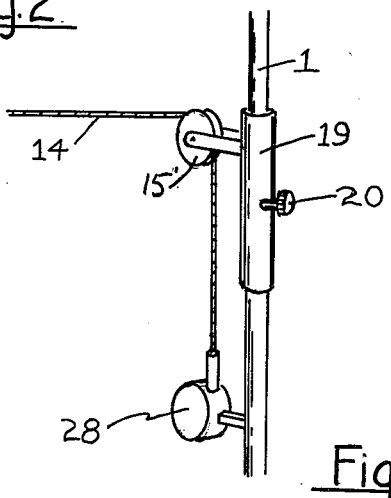
FIG. 6 is a partial view of another embodiment of the invention indicating the use of a spring loaded cord reel.

A constructional variation of the equipment is shown in the embodiment of FIG. 6. In this embodiment of the invention the clamp 10 and cleat 17 of FIG. 1 has been replaced by an assembly comprised of the sliding tubular member 19, the pulley 15', the spring loaded reel 28 and the adjusting screw 20. Spring loaded reel 28 may be permanently attached to standard 1. The cord 14 is entirely stored within reel 28 when the apparatus is not in use. In the setting up of this embodiment the cord is pulled from reel 28, passed through pulley 15', extended across the pool through pulley 15 of clamp 10*a* and anchored at cleat 17*a*. Adjusting screw 20 and clamp 10*a* are used to position cord 14 at any desired height as defined by the position of holes 11. In this embodiment more tolerance is permitted in diver performance inasmuch as slight contact with the cord 14 will cause it to extend somewhat against the spring in reel 28. The cord will then return to its normal position and there will be no pullout of clamp 10*d*. A poor dive will however still produce safe release of the cord.

I claim:

1. A diving game for swimming pools comprised of:

a. a hurdle;

b. releasable means for mounting said hurdle across a swimming pool;

c. two water weighted supports provided with vertical sockets;

d. two vertical standards of a diameter to fit said vertical sockets, each standard containing equally spaced holes along its length;

e. two clamp means each fastenable to a respective standard, at least one of said clamp means being a clamp formed into spreadable fingers and a pin at one end and having a pulley at the other, whereby one support and vertical standard are positioned at each side of the pool and said hurdle is formed by passing the ends of a cord through said clamp means and through the pulley in said clamp, fixing each clamp means to its respective standard with said clamp fixed to its standard by inserting said pin into one of the equally spaced holes and then spreading said fingers to fit around the standard at the height of the chosen hole, tightening the cord and tying down its ends, said clamp having holding power against pressure on the cord up to a point where said fingers are forced apart.

2. A diving game as set forth in claim 1 in which said water weighted supports are open containers having a central portion drilled to form said vertical sockets, said containers being partially filled with water to provide weight and stability.

3. A diving game as set forth in claim 1 in which the other of said clamp means is a slidable cylinder mounted on one of said standards, said cylinder incorporating a pulley to receive said cord and set screw.

4. A diving game as set forth in claim 1 in which said cord is contained in a spring loaded reel permanently fixed to one of said standards whereby the cord can be slightly disturbed during the playing of the game without the release of the spreadable fingers but with retention of release properties when pressure is increased.

* * * * *